United States Patent [19]

Maglio, Jr.

[11] 3,945,588

[45] Mar. 23, 1976

[54] ANTI-TANK MISSILE

[76] Inventor: Melvin R. Maglio, Jr., P.O. Box 4031, San Francisco, Calif. 94101

[22] Filed: June 18, 1973

[21] Appl. No.: 370,840

[52] U.S. Cl. ..... 244/3.16
[51] Int. Cl. ..... F42b 15/00
[58] Field of Search ..... 244/3.16

[56] References Cited

UNITED STATES PATENTS

| | | | |
|---|---|---|---|
| 3,504,869 | 4/1970 | Evans et al. | 244/3.16 |
| 3,642,233 | 2/1972 | Bezerie | 244/3.16 |

*Primary Examiner*—Samuel W. Engle
*Assistant Examiner*—C. T. Jordan

[57] ABSTRACT

This invention which is a surface to surface anti-tank missile following a modified ballistic trajectory incorporating a guidance computer system with manual setting (ascending mode) and infrared optical system (descending mode), solid fuel rocket motor and a shaped charge high explosive warhead is designed as an effective and inexpensive means for the destruction of armored vehicles.

1 Claim, 4 Drawing Figures

SCHEMATIC OF TRACKING CONTROL SYSTEM DESCENDING MODE

ANTI-TANK MISSILE

An object of this invention is to provide a means by which the destruction of armored vehicles may be accomplished through the safety provided by the indirect fire method.

Another object of this invention is to provide a means by which a shaped charge high explosive warhead may be placed upon the engine compartment of the armored vehicle.

A third object of this invention is to provide a means by which the large investment represented by an armored vehicle may be defeated by the small investment represented by a missile of the type herein described and illustrated.

A fourth object of this invention is to provide a means for the destruction of armored vehicles which is highly portable.

A fifth object of this invention is to provide a means for the destruction of armored vehicles not requiring highly trained personnel.

A detailed description of the invention now follows in conjunction with the appended drawings in which.

Figure 1:
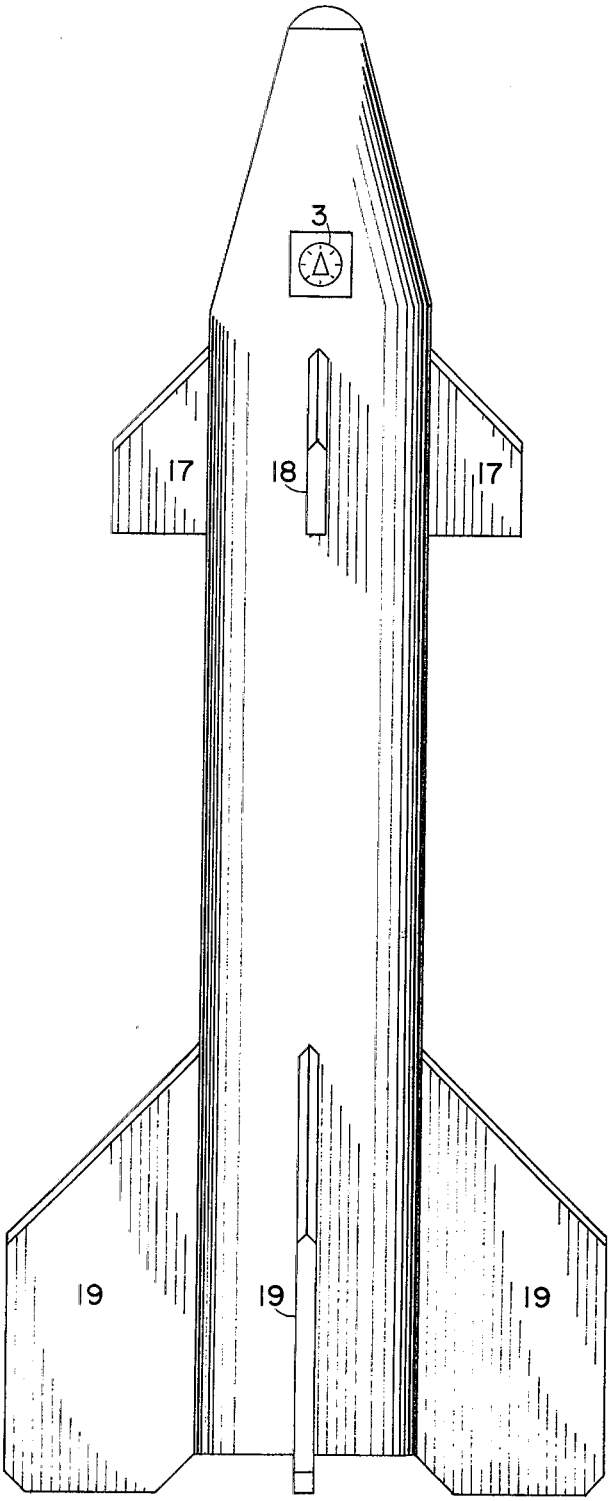
FIG. 1 is an exterior view of the modified trajectory infrared guidance tank exterminator.
Figure 2:
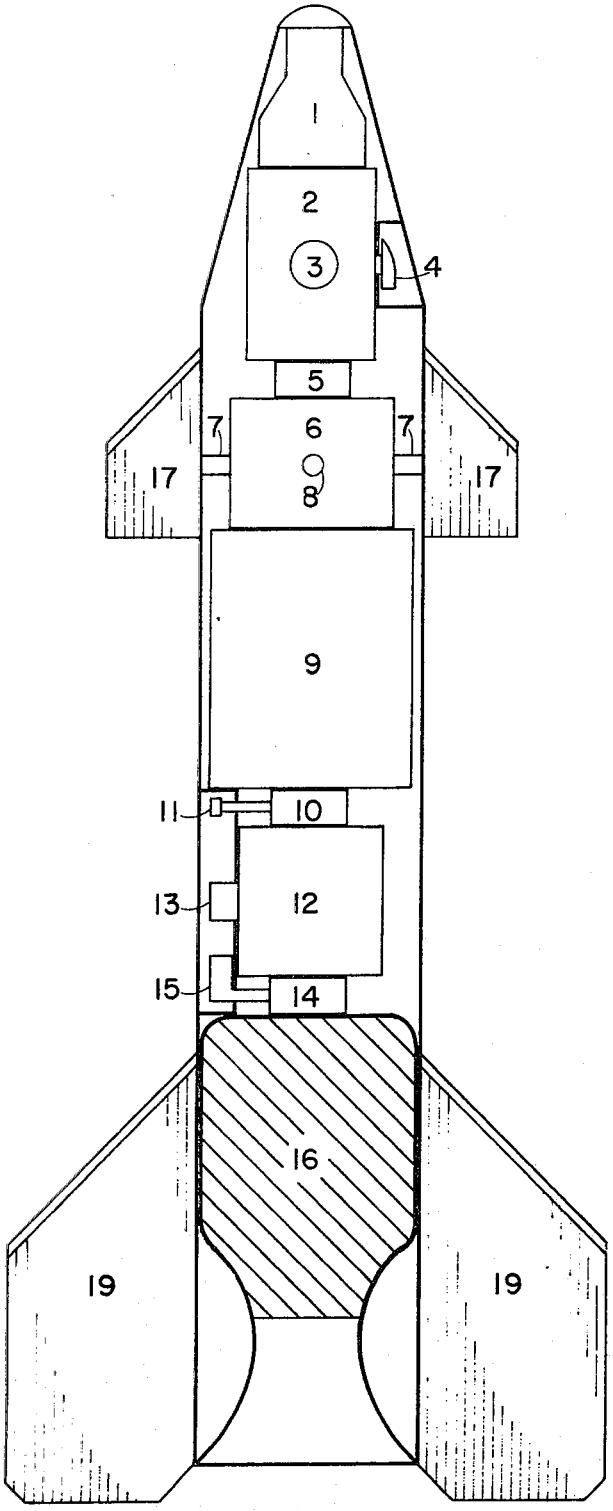
FIG. 2 is an exposed view showing location of the internal components of the missile.

In operation the operator will first place the indirect trajectory infrared guidance tank exterminator in such a position that it stands vertically on the aerodynamic stabilization fins 19 which also function as the missile support stand with the infrared optical system 1 at the uppermost point. The operator will then determine the direction to the target by means of taking a compass reading of the direction of said target from his position. The operator will then set the lateral aerodynamic attitude control adjustment 3 in accordance with said reading which will automatically set the computer controlled aerodynamic control activation system 6 for the correct directional heading.

The operator will then determine the approximate distance of the indirect trajectory infrared guidance tank exterminator from the target and then set the vertical aerodynamic attitude control adjustment 4 to the correct setting in accordance with said estimated range to the target which will automatically set the computer controlled aerodynamic control activation system 6 for the correct vertical angle of flight which determines the range of the indirect trajectory infrared guidance tank exterminator.

The operator will then activate the shaped charge detonating mechanism 10 by use of the detonating lock release 11.

The operator will then rotate the electrical systems activation switch 13 which will connect the electrical power source 12 and activate all electrical systems of the indirect trajectory infrared guidance tank exterminator with the exception of the infrared optical system 1.

The operator will then attach an insulated electrically conductive wire to the quick release rocket motor ignition input electrical coupler 15 whereupon said operator will unreel said wire to a point where the operator will be safe from the blast effect of the solid fuel rocket motor 16.

The operator will then activate an electrical charge generator or similar device which will produce an electrical current through the insulated electrically conductive wire through the quick release rocket motor ignition input electrical coupler 15 and into the solid fuel rocket motor igniter 14 whereupon ignition of the solid fuel rocket motor 16 takes place.

The indirect trajectory infrared guidance tank exterminator is then lifted from the surface upon which it has been resting under the action of the gases generated by the said solid fuel rocket motor 16.

Aerodynamic forces acting upon the aerodynamic directional control surfaces 17 and 18 guide the indirect trajectory infrared guidance tank exterminator along the correct modified ballistic flight path. The aerodynamic directional control surfaces 17 and 18 are acted upon by the aerodynamic control activation system 6 through the control rods 7 and 8 in accordance with the input information of the vertical aerodynamic attitude control adjustment 4 and the lateral aerodynamic attitude control adjustment 3 as supplied by the operator, prior to the ignition of the solid fuel rocket motor 16, through the guidance computer 2.

Upon burnout of the solid fuel rocket motor 16, the indirect trajectory infrared guidance tank exterminator will coast upwards for some distance due to its own momentum; after which it will begin a downwards modified ballistic trajectory towards the earth.

Figure 3:
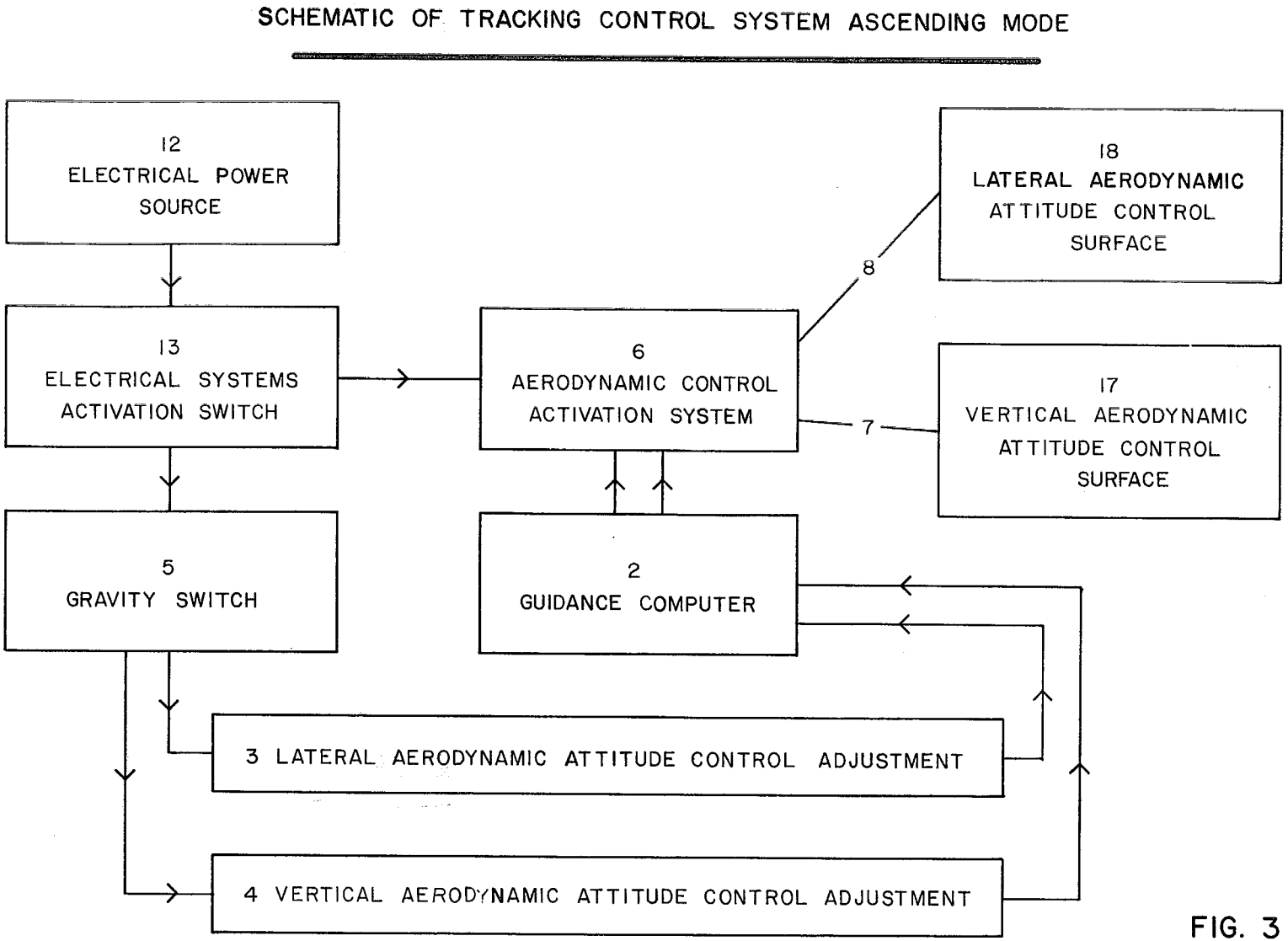
FIG. 3 is a schematic chart of the tracking control system ascending mode.
Figure 4:
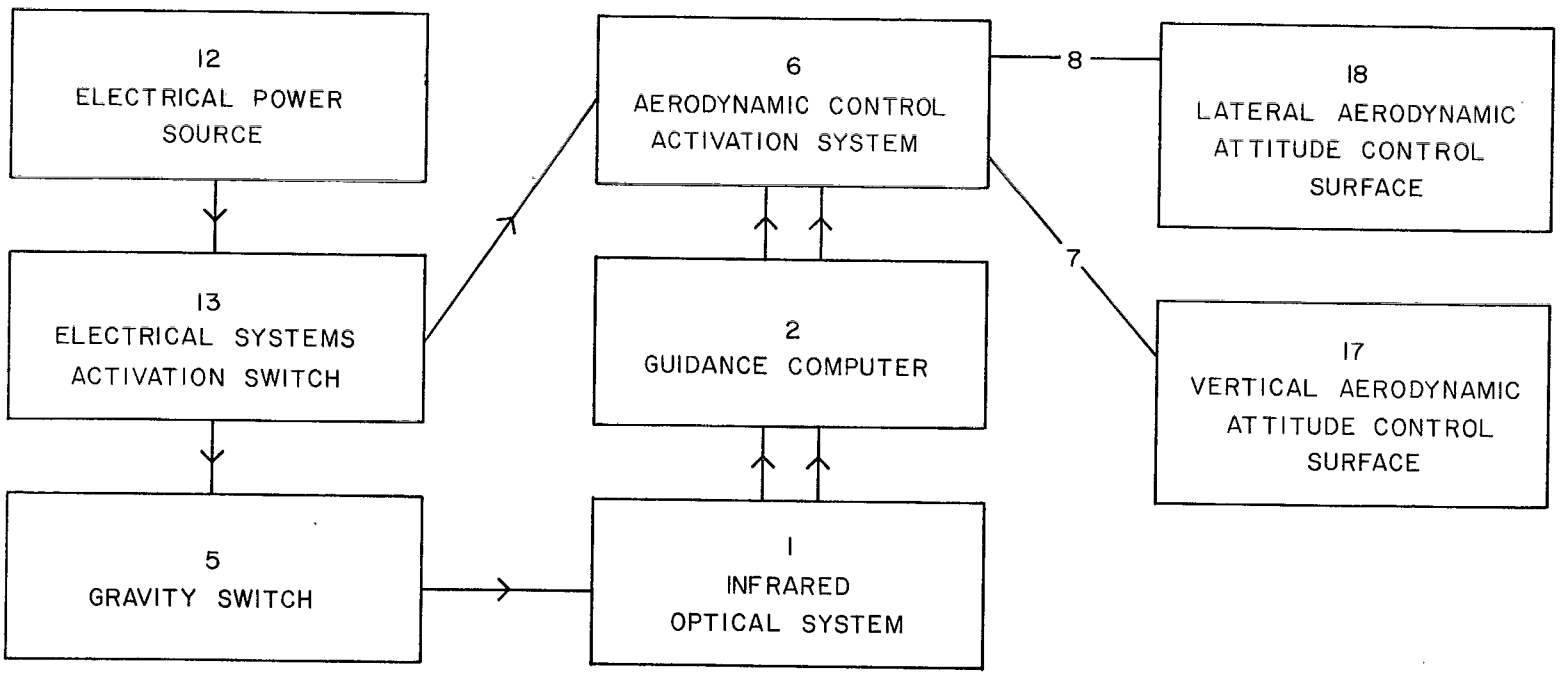
FIG. 4 is a schematic chart of the tracking control system descending mode.

Aerodynamic forces acting upon the indirect trajectory infrared guidance tank exterminator will cause the forward portion containing the infrared optical system 1 to assume the bottommost or downward position at which point the gravity switch 5 will inactivate the manually adjusted tracking control system ascending mode (FIG. 3) and in turn activate the infrared guidance tracking control system descending mode (FIG. 4).

The infrared guidance tracking control system descending mode will then locate the greatest source of infrared energy in the area immediately below through the infrared optical system 1 and activate the aerodynamic directional control surfaces 17 and 18 through the control rods 7 and 8 and the guidance computer 2 in such a manner that the indirect trajectory infrared guidance tank exterminator is directed to the engine compartment of the target vehicle since this will be the greatest source of infrared radiant energy.

Upon reaching the engine compartment of the target vehicle a detonating mechanism 10 will detonate the high explosive shaped charge warhead 9 which will absolutely ruin the engine, transmission system and everything else in the immediate vicinity and also ignite anything flammable in the immediate area such as fuel.

It is to be understood that changes in form, size and construction may be made in the device shown and herein described without departing from the spirit of the invention and the scope of the appended claims.

What is claimed is:

1. A surface to surface guided missile incorporating a solid fuel rocket motor activated through a quick release rocket motor ignition input electrical coupler, guidance in the ascending mode being provided by vertical aerodynamic attitude control surfaces and lateral aerodynamic attitude control surfaces actuated by control rods actuated by an aerodynamic control activation system under the control of a guidance computer in accordance with input from a vertical aerodynamic attitude control adjustment and a lateral aerodynamic attitude control adjustment input being provided by a gravity switch through an electrical systems activation switch from an electrical power source, guidance in the descending mode being provided by said vertical aerodynamic attitude control surfaces and said lateral aerodynamic attitude control surfaces actuated by said control rods actuated by said aerodynamic control activation system under control of said guidance computer according to input from an infrared optical system activated by said gravity switch by input from said electrical systems activation switch under input from said electrical power source, the transfer from the ascending to the descending mode of guidance being accomplished by means of said gravity switch, input in the ascending and descending modes being provided to the aerodynamic control activation system by the electrical power source through the electrical systems activation switch, the said vertical aerodynamic attitude control adjustment and the said lateral aerodynamic attitude control adjustment being manually adjusted by the operator prior to launching of the missile, the said electrical systems activation switch being also manually actuated by the operator prior to the launching of the missile, the operator will also manually actuate the detonating lock release prior to the launching of the missile which will permit the detonating mechanism to function upon the arrival of the missile at the source of infrared energy upon termination of the descending mode said functioning of the said detonating mechanism activating the high explosive shaped charge warhead, the missile being provided with aerodynamic stabilization fins, functioning during the ascending and descending modes, which will also function as a missile support stand.

* * * * *